United States Patent [19]

Bridge

[11] Patent Number: 4,550,599

[45] Date of Patent: Nov. 5, 1985

[54] APPARATUS FOR RESTRAINING ELECTRONIC ASSEMBLIES

[75] Inventor: Michael L. Bridge, Houston, Tex.

[73] Assignee: Dresser Industries, Inc., Dallas, Tex.

[21] Appl. No.: 459,865

[22] Filed: Jan. 21, 1983

[51] Int. Cl.[4] ..... E21B 47/00

[52] U.S. Cl. ..... 73/151; 73/431

[58] Field of Search ..... 73/151, 431, 152; 248/27.1; 361/399, 415

[56] References Cited

U.S. PATENT DOCUMENTS 3,995,479 12/1976 Chapman, III ..... 73/151

4,335,602 6/1982 Walkow ..... 73/152

FOREIGN PATENT DOCUMENTS 815267 3/1981 U.S.S.R. ..... 73/151

*Primary Examiner*—Jerry W. Myracle

*Attorney, Agent, or Firm*—Patrick H. McCollum; Richard M. Byron

[57] ABSTRACT

Electronic circuitry to assist in obtaining measurements of subsurface formation parameters is mounted on an elongated chassis member removably disposed within a tubular housing. One or more restraining assemblies are disposed along the length of the chassis. Each restraining assembly includes a cam member biased into engagement with the inner periphery of the housing to provide a substantially rigid restraint of the chassis within the housing. An inertial latch is used to constrain the cam member within the chassis for insertion within the housing. A pair of fixed contact members are angularly disposed about the chassis in radially spaced apart relationship with the cam member to provide three contact points with the housing.

17 Claims, 6 Drawing Figures

FIG. 3
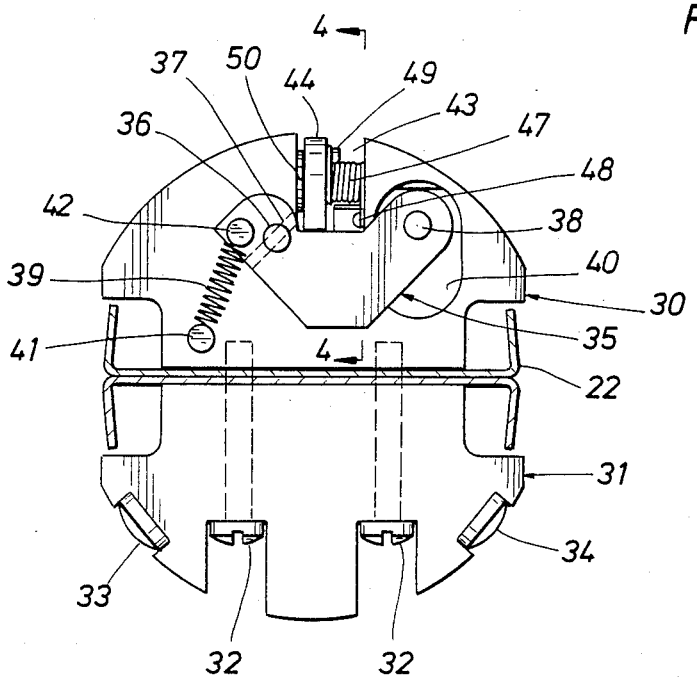
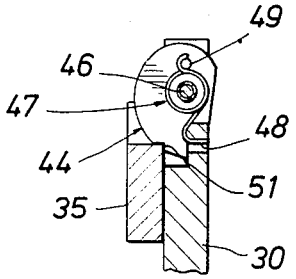
FIG. 4
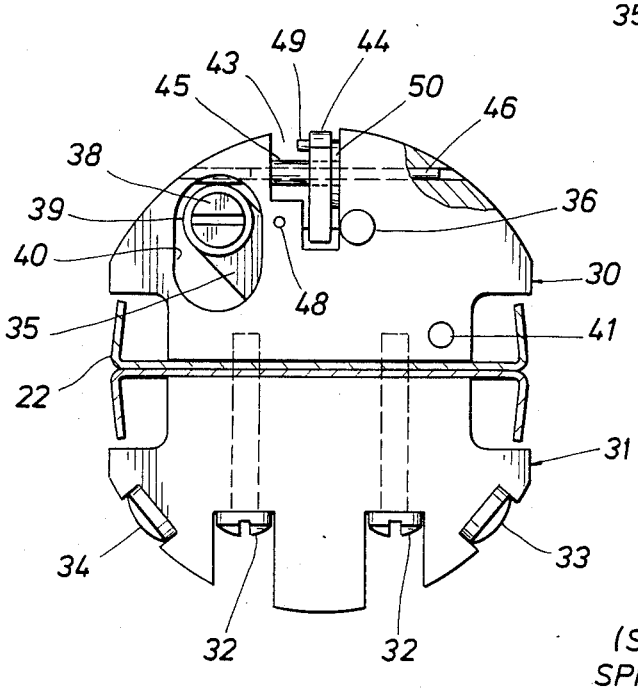
FIG. 5
(SHOWN WITH SPRING 47 REMOVED)

APPARATUS FOR RESTRAINING ELECTRONIC ASSEMBLIES

BACKGROUND OF THE INVENTION

This invention relates to improved well logging methods and apparatus, and more particularly relates to novel methods and apparatus for reducing damage to electronic instrument assemblies caused by vibration, shock and physical abuse.

It is well known that oil and gas are found in subsurface earth formations, and that wells are drilled into these formations to recover such substances. However, it is usually necessary to survey or log the length of the borehole to ascertain if any of the formations contain significant recoverable amounts of oil and gas to justify completing the well.

There is no single well logging technique or device which can provide a direct indication and evaluation of oil or gas in a particular formation of interest. Instead a variety of logging techniques have been devised, which measure various different physical parameters of the earth substances adjacent the borehole. Since no one earth parameter can of itself provide a definitive and conclusive indication of the presence of oil and gas in commercial quantities, there has been a continuing need to perform as many different types of logging measurements as possible.

The various subsurface measuring systems require a considerable amount of downhole electronics circuitry for obtaining the desired subsurface parameters. These electronics systems can weigh in excess of forty pounds and can extend over six feet in length. The severe space restrictions and the rigorous borehole environmental conditions require that the downhole electronics circuitry be sealingly enclosed within a tubular housing of relatively small diameter. To comply with assembly, repair and maintenance requirements of the downhole electronics, typically the electronics circuit components are mounted along a length of narrow metal chassis member which is removably installed within an elongated tubular housing. The enclosure is sealed so as to protect the electronics assembly from exposure to pressure and fluids within the borehole.

In performing typical logging operation, an instrument is lowered, by means of a cable suspending the instrument within the well, to a point in the borehole. The instrument is then caused to traverse the borehole while measuring a selected parameter of the subsurface formation. During the traversal of the borehole, the downhole assembly must be able to withstand extreme shock and severe vibration which are imposed on the measuring device.

The severe environment in which these devices are required to operate presents a major problem when designing the subsurface electronics assembly. The requirement that the electronic components be mounted on a relatively long and slender chassis will leave the assembly susceptible to damage due to extreme shock and severe vibration unless the chassis is securely retained within the housing. Further, the chassis member must be securely retained within the housing by a retaining method which allows simple removal and installation of the chassis within the housing.

Accordingly, the present invention overcomes these difficulties by providing an apparatus for protecting the subsurface electronics from damage due to shock and vibration while providing easy removal and insertion of the electronics assembly within the protective housing.

SUMMARY OF THE INVENTION

Apparatus for investigating earth formations traversed by a borehole according to the invention includes a chassis member equipped with a rigid retaining system to prevent damage from shock and vibration. The retaining system includes a plurality of radially spaced apart buttonheads in cooperative arrangement with a spring biased cam assembly and a spring loaded inertial latch. The inertial latch includes an arm having a first weighted end and a second end pivotal affixed to a mounting plate. A constant force spring connected between the second end of the arm and the mounting plate provides a bias force to the arm. The cam assembly includes a spiral cam having a torsional force applied thereto by a second spring. Prior to insertion of the chassis member into the housing the cam is latched into a restrained position by registry of the latching arm into a notch provided within the cam. After insertion of the chassis member the spring loaded arm is caused to release the cam by an inertial shock. The torsional force exerted upon the cam by the second spring rotates the cam causing engagement of the cam with the inner circumference of the housing resulting in a rigid restraint system to prevent movement of the chassis when the device is subjected to shock and vibration.

Accordingly, it is a feature of the present invention to provide new and improved downhole electronics retention means for reducing damage due to vibration and shock.

Another feature of the present invention is to provide new and improved retaining means which allow simple assembly and disassembly of the subsurface device.

A further feature of the present invention is to provide new and improved rigid mounting retaining assembly for positively restraining an electronics chassis within an elongated housing.

BRIEF DESCRIPTION OF THE DRAWINGS

FIG. 3 is a cut-away view of the present restraining means taken on the 3—3 line of FIG. 2.

FIG. 4 is a cut-away view of a portion of the restraining means taken on the 4—4 line of FIG. 3.

FIG. 5 is a cut-away view of a portion of the restraining means taken on the 5—5 line of FIG. 2.

DETAILED DESCRIPTION OF THE DRAWINGS

Figures 1, 6:
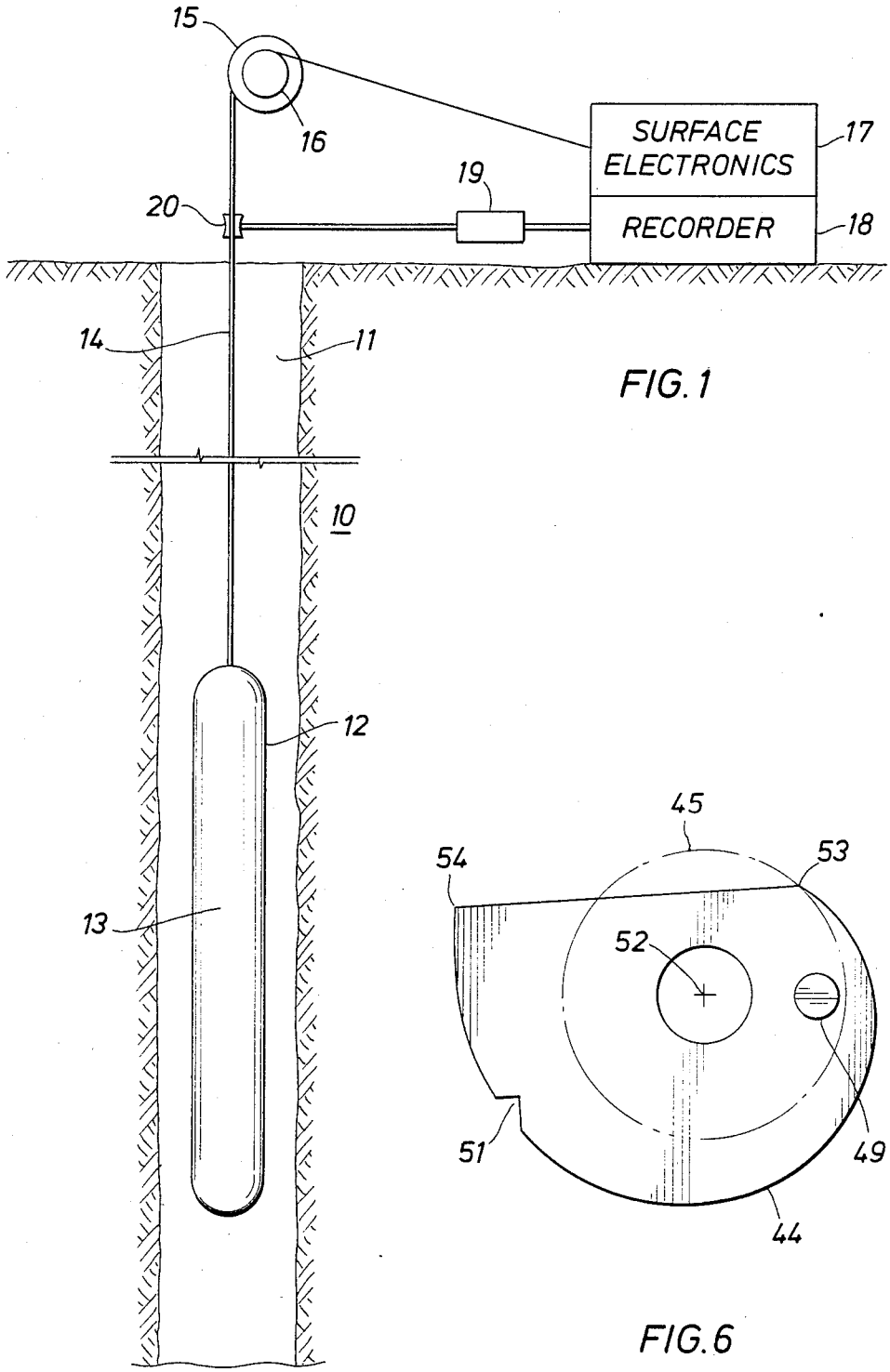
FIG. 1 is a pictorial view, partly in cross-section, of a typical well logging instrument suspended in a borehole.
FIG. 6 is a close-up view of the locking cam of the restraining means of the present invention.

Referring now to the drawings in detail, particularly to FIG. 1, there is illustrated schematically a well surveying operation in which a portion of the earth's surface 10 is shown in vertical section. An earth borehole 11 penetrates the earth's suface and may or may not be cased. Disposed within the well is the subsurface instrument 12 of the well logging system. As is well known in the art, subsurface instrument 12 can be a resistivity, acoustic, radioactivity or any one of the other instruments used for measuring subsurface parameters.

Subsurface instrument 12 is partially comprised of an electronics section 13 which houses a chassis member upon which is mounted the electronics components required for the operation of instrument 12. Cable 14 suspends instrument 12 in the well and contains the required conductors for electronically connecting the instrument with the surface apparatus. Cable 14 is wound on or unwound from drum 15 in raising and lowering instrument 12 to traverse the well.

In making the well log, instrument 12 is caused to traverse the well. Thereby, a measurement of at least one formation parameter is obtained. The resultant signal is sent to the surface through conductors within cable 14. Through slip rings and brushes 16 on the end of drum 15, the signals are coupled into surface electronics 17. After processing by the circuitry therein the resulting information is recorded on recorder 18. Recorder 18 is driven through transmission 19 by a measuring reel 20 over which cable 14 is drawn so that recorder 18 moves in correlation with the depth as instrument 12 traverses the well. It should be understood that the housing for instrument 12 is constructed to withstand the pressures and mechanical and thermal abuses encountered in logging a well.

Figure 2:
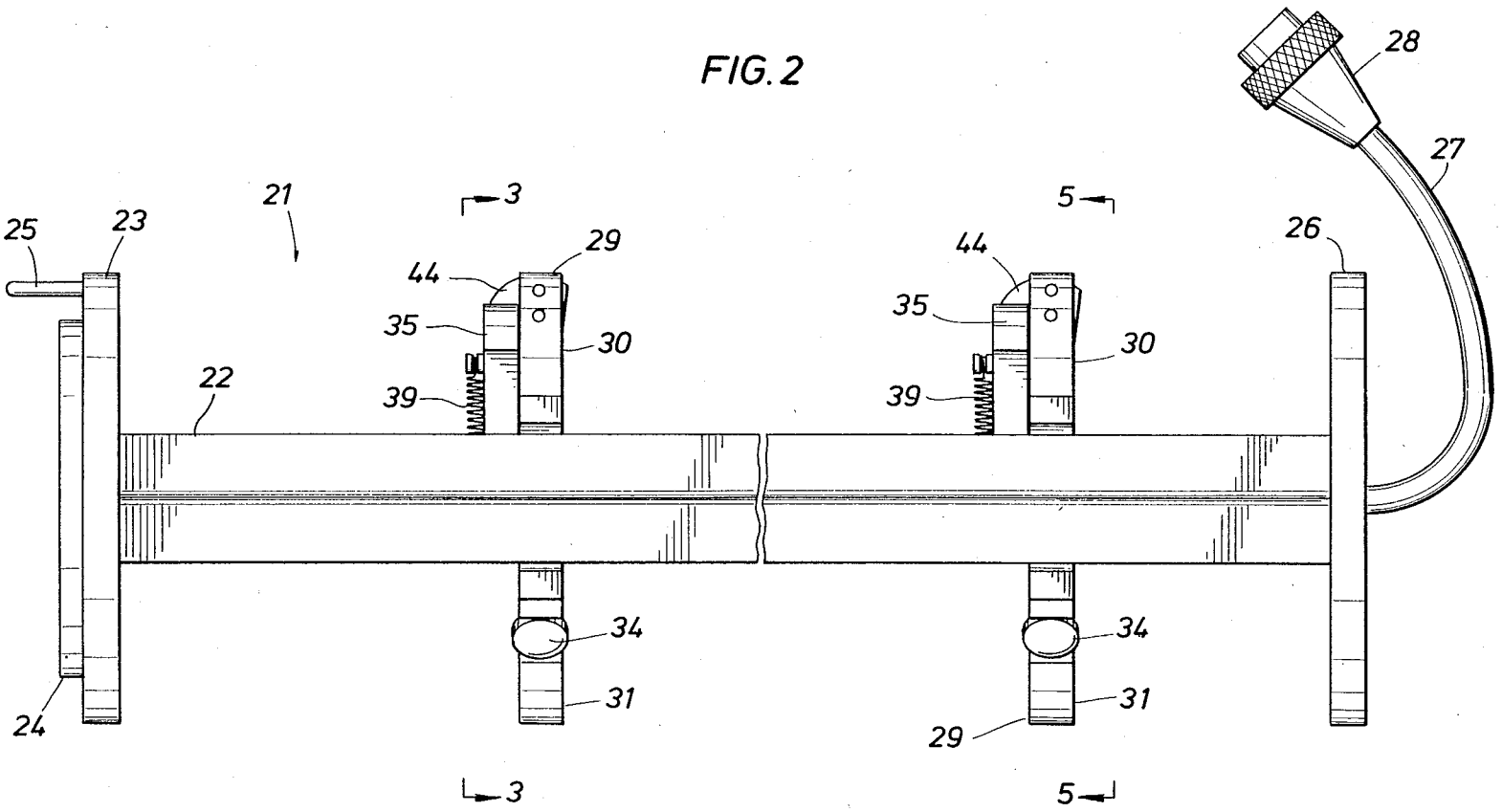
FIG. 2 is a view of an elongated electronics chassis utilizing the restraining means of the present invention.

Referring now to FIG. 2, there is illustrated an elongated chassis member 21 on which the electronic components needed in subsurface electronics 13 are mounted. Chassis member 21 is comprised of a relatively thin, elongated body member 22 for mounting the electronic components thereon, and a lower plate assembly 23, upon which is affixed electric plug 24 and guide pin 25. Guide pin 25 is to assure the proper alignment of plug 24 when the instrument is inserted within the tubular housing and prevent rotation of chassis member 22 after installation therein. Plug 24 provides electrical connection from the electronics circuitry to the lower section of subsurface instrument 12. Additionally, lower plate 23, along with upper plate 26 provide suupport for the ends of chassis member 21 when installed within the housing. Electrical cable 27 and plug 28 provide the required electrical connections for getting power to and transferring signals from the electronic circuitry mounted along the length of chassis member 22. Although elongated chassis member 22 is illustrated as being a H-frame chassis, it should be understood that the present invention may be utilized on any chassis frame configuration typical in the art.

Mounted at selected intervals along the length of chassis member 21 are one or more retaining assemblies 29. Referring to FIGS. 3 and 5 there is illustrated views of such retaining assemblies from both sides. Equivalent elements in the views have been numbered similarly. Retaining assembly 29 includes first and second plate members 30 and 31, respectively, affixed to chassis body 22 by any suitable method, such as screws 32. Threadably mounted on in radially spaced apart locations and slightly extending beyond the periphery of plate member 31 is a pair of buttonheads 33 and 34. Buttonheads 33 and 34 preferably are angularly disposed on plate member 31 at 90° from one-to-another. The hemispherical heads of buttonheads 33 and 34 allow for slidable engagement with the interval circumference of the instrument housing as chassis member 21 is slidably installed into and removed from the housing and provide two points of the mounting system.

Turning now to plate member 30, lever arm 35 is pivotally affixed to plate member 30 by pivot shaft 36 and pin 37. Pin 37 affixes arm 35 to pivot shaft 36 and prevents arm 35 from sliding on pivot shaft 36. Mounted on one end section of arm 35 by suitable means, such as screw 38, is weight 39. With arm 35 affixed onto plate member 30 weight 39 extends into aperture 40 within plate member 30. Affixed to the other end section of arm 35 at point 42 is one end of spring 39, the other end of which is affixed to a point 41 on plate member 30. Spring 39 preferably is a cylindrical helical spring of circular cross section. The tension force exerted on arm 35 by spring 39 biases the weighted end of section arm 35 into an upward position as illustrated in the Figures.

Located at the approximate mid point of the periphery of plate member 30 is an inverted L-shaped notch 43. Mounted within notch 43 is a spring biased cam assembly. The cam assembly includes a spiral cam 44 coupled to bushing 45. Bushing 45 and cam 44 are rotatably secured within notch 43 by pin 46. Spring 47, a cylindrical helical spring of circular cross section, has one end affixed to plate member 30 at 48 and a second end affixed to cam 44 at 49 so as to exert a torsional bias to cam 44. Spacer or washer 50 separates can 44 from plate member 30 thereby allowing rotation of cam 44 about pin 46. Notch 43 is located in plate member 30 so that cam 44 is disposed at approximately 135° from both buttonheads 33 and 34 thereby providing three radial points of support for chassis member 21 with the instrument housing.

A more detailed view of the cam assembly is illustrated in FIG. 4. Therein is shown a cross sectional view of plate member 30 and arm 35. It should be understood that the various views of the cam assembly illustrate cam 44 in a locked position. This is the preferable position for insertion of chassis member 21 into the instrument housing. As illustrated in FIG. 4, cam 44 is rotated in a counter clockwise direction until spring loaded arm 35 latches into notch 51 on the periphery of cam 44.

Referring now to FIG. 6, there is illustrated cam 44 of the cam assembly. Cam 44 is a spiral cam having an involute outer periphery. As is illustrated, cam 44 has a portion thereof having an increasing radius from the center to the periphery. In the preferred embodiment the radius increases from a minimum radius of 0.200 inches between points 52 and 53 to a maximum radius of 0.355 inches between points 52 and 54. Additionally, notch 51 is located at a position along the periphery of cam 44.

In the operation of the retaining assembly of the present invention, prior to insertion of chassis member 21 within the instrument housing cam 44 is rotated in a counter clockwise direction until spring biased arm 35 latches into notch 51 on cam 44. Chassis assembly 21 is inserted into the longitudinal instrument housing and aligned for mechanical and electrical engagement of pin 25 and plug 24. To release the spring loaded inertial latch system of the retainer assembly the instrument is subjected to a shock which can be provided from normal jarring due to transportation or by a rap on the outer housing by any suitable manner such as by striking the instrument housing with a hammer. In the preferred embodiment the spring loaded latch arm 35 is biased so as to release cam 44 at approximately 4.0 pounds of force. Once released, cam 44 rotates in a clockwise direction due to the torsional bias of spring 47 until chassis member 21 is rigidly restrained within the instrument housing by buttonheads 33 and 34 and cam 44 contacting the inner wall of the housing. To remove chassis member 21 from the instrument housing a longitudinal force is exerted upon a chassis member 21 from the upper plate 26 end the frictional forces thus exerted causing cam 44 to rotate in a counter clockwise direction allowing removal of chassis member 21.

In an alternate embodiment of the present invention, where the design of the subsurface instrument allows the chassis member 21 to be inserted from a first end and removed from a second end spring, loaded latch arm 35 can be eliminated. Insertion of chassis member 21 from the first end rotates cam 44 in a counter clockwise direction due to frictional forces resulting from cam 44 sliding along the inner circumference of the housing. Once in place cam 44 rotates into restraining engagement with the inner wall of the housing. Removal of chassis member 21 from the second end utilizes the same functional forces to cause counter clockwise rotation of cam 44.

Many modifications and variations besides those specifically mentioned may be made in the techniques and structures described herein and depicted in the accompanying drawings without departing substantially from the concept of the present invention. For example, the restraining assembly of the present invention may find utility in environments other than wireline well logging, such as a downhole "measuring-while-drilling" systems. One such system can be found in U.S. Pat. No. 3,827,294. Accordingly, it should be clearly understood that the forms of the invention described and illustrated herein are exemplary only, and are not intended as limitations on the scope of the present invention.

The embodiments of the invention in which an exclusive property or privilege is claimed are defined as follows:

1. A system for restraining an elongated instrument chassis adapted for mounting electronic circuitry thereon within a tubular housing, comprising:

a biased cam assembly for providing substantially rigid restraint of said chassis within said housing said cam assembly comprising;

a cam cooperatively arranged on said instruemnt chassis; and bias means for biasing said cam into cooperative engagement with said housing; and means for latching said cam assembly in a retracted position on said chassis for allowing insertion of said chassis within said housing.

2. The restraining system of claim 1 wherein said latching means comprises an inertial releasing latch.

3. The restraining system of claim 2 wherein said inertial releasing latch comprises:

an arm member; and bias means for biasing said arm into cooperative engagement with said cam assembly.

4. A restraining system for use in a well logging apparatus including an elongated tubular housing and an elongated instrument chassis adapted for positioning within said housing, comprising:

a cam rotatably mounted on said instrument chassis; and bias means coupled to said cam for biasing said cam into cooperative engagement with said housing and an inertial releasing latch means for constraining said cam in a latched position.

5. The restraining system of claim 4 wherein said inertial releasing latch means comprises:

an arm member having a first weighted end portion and a second pivotably attached end portion;

biasing means for biasing said arm into latching engagement with said cam.

6. The restraining system of claim 5 wherein said inertial releasing latch means releases said cam from a constrained position at approximately four pounds of inertial force.

7. The restraining system of claim 4 wherein said cam comprises a spiral cam at least a portion of which having an outer periphery of increasing radius.

8. The restraining system of claim 10 further comprising a pair of radially spaced contact members cooperatively arranged on said chassis.

9. The restraining system of claim 8 wherein said contact members are radially disposed by 90 degrees.

10. The restraining system of claim 9 wherein said cam is radially disposed by 135 degrees from both of said pair of contact members.

11. Well logging apparatus for investigating subsurface earth formations traversed by a borehole, comprising:

an elongated tubular housing adapted to traverse said borehole;

an elongated instrument chassis adapted for positioning within said tubular housing;

a pair of buttonheads angularly disposed and mounted on said chassis;

at least one spring biased cam member angularly disposed from said buttonheads and mounted on said chassis, said cam member engaging said housing when said chassis is inserted therein.

12. The apparatus of claim 11 further comprising an inertial releasing latch means for selectively constraining said cam member within said chassis.

13. The apparatus of claim 12 wherein said inertial releasing latch means comprises an arm member biased into engagement with said cam member.

14. A system for restraining an elongated instrument chassis within a tubular housing, comprising:

a biased cam assembly for providing substantially rigid restraint of said chassis within said housing; and an inertial releasing latching means for releasing said cam assembly from a contrained position upon an inertial shock.

15. The restraining system of claim 14 wherein said cam comprises a spiral cam at least a portion of which has an outer periphery of increasing radius.

16. The restraining system of claim 15 wherein said inertial releasing latch means comprises:

an arm member having a first weighted end portion and a second pivotably attached end portion;

biasing means for biasing said arm into latching engagement with said cam.

17. The restraining system of claim 16 wherein said inertial releasing latch means releases said cam from a constrained position at approximately four pounds of inertial force.

* * * * *